United States Patent [19]

Ragland, Jr.

[11] Patent Number: 4,719,787

[45] Date of Patent: Jan. 19, 1988

[54] APPARATUS FOR FORMING A SHADOW MASK

[75] Inventor: Frank R. Ragland, Jr., Manheim Township, Lancaster County, Pa.

[73] Assignee: RCA Corporation, Princeton, N.J.

[21] Appl. No.: 901,569

[22] Filed: Aug. 29, 1986

[51] Int. Cl.[4] ..... B21D 22/00

[52] U.S. Cl. ..... 72/347; 72/348; 72/350

[58] Field of Search ..... 72/347, 350, 351, 352, 72/354, 358, 359, 348

[56] References Cited

U.S. PATENT DOCUMENTS

| | | | |
|---|---|---|---|
| 3,195,341 | 7/1965 | Zunich | 72/465 |
| 3,296,850 | 1/1967 | Fiore | 72/351 |
| 3,621,699 | 11/1971 | Valek et al. | 72/348 |
| 4,090,389 | 5/1978 | van Denderen et al. | 72/350 |
| 4,615,205 | 10/1986 | Ragland | 72/347 |

*Primary Examiner*—Robert L. Spruill
*Assistant Examiner*—Donald R. Studebaker
*Attorney, Agent, or Firm*—E. M. Whitacre; D. H. Irlbeck; T. H. Magee

[57] ABSTRACT

An apparatus for forming a shadow mask from a mask blank includes a punch having a convex surface, a pad having a complementary concave surface, and upper and lower dies having openings therein for receiving the punch and the pad, respectively. Each die also has a complementary nonplanar surface adjacent the opening for clamping the mask blank. Each die surface has a surface contour that substantially matches the extended surface contour of the mask blank when the mask blank lies against the inner edge of the lower die surface, so that wrinkling does not occur when the mask blank is clamped between the upper and lower dies.

6 Claims, 6 Drawing Figures

APPARATUS FOR FORMING A SHADOW MASK

BACKGROUND OF THE INVENTION

This invention pertains to an apparatus for forming a shadow mask for a color cathode-ray tube from a mask blank including a punch, a pad, and upper and lower dies for clamping the mask blank.

A color cathode-ray tube (CRT) employs three electron guns for emitting three electron beams which pass through a common deflection yoke, with one beam for each primary phosphor color, i.e., red, green and blue. The beams are "shadowed" by a perforated conductive mask, known as a shadow mask, so that each beam can strike but one color of a segmented cathodoluminescent screen of red, green and blue phosphors disposed close to the mask on the inside surface of a faceplate panel. At the point where the electrons from one of the guns impinge on the screen, one of the color phosphors is deposited in a spot or line that approximates the size of the mask aperture. All other parts of the phosphor screen are in the "shadow" of the phosphor mask, as far as this one gun is concerned. Thus, the position and size of the apertures in the shadow mask are important ultimately to achieve good color purity.

A conventional spherical-like shadow mask is formed from a flat mask blank by first clamping the blank around its periphery between upper and lower dies having openings therein for receiving a punch having a convex surface and a pad having a complementary concave surface. The punch and the pad are shaped with a spherical-like surface contour that provides the desired mask contour, i.e., allowance is made for springback after forming. The clamping surfaces of the upper and lower dies, adjacent the respective openings, typically have a nonplanar surface contour which is a continuation of the spherical-like surface contour of the punch surface. Consequently, when the mask blank is laid onto the lower die surface, the surface contour assumed by the blank does not match the surface contour of the die, resulting in a wrinkling of the blank as it is clamped between the upper and lower dies.

In forming the shadow mask, the wrinkles in the clamped mask blank must be stretched out to achieve a smooth surface contour. In particular, the initial portions of the mask skirt are formed while the mask blank is still clamped between the upper and lower dies, thereby stretching out the periphery of the mask to provide a smoother contour. However, in this stretching-out process, the mask apertures in the wrinkled areas stretch differently than those apertures not in wrinkled areas. This causes nonuniform stretching in the mask and, since the wrinkles are different from mask to mask, the stretching is different from mask to mask. Such nonuniform stretching of the shadow mask ultimately results in a lowering of color purity in larger size cathode-ray tubes and in high-resolution display tubes. It is desirable to have an apparatus for forming a shadow mask which avoids such a degradation in color purity.

SUMMARY OF THE INVENTION

The present invention comprises an apparatus for forming a shadow mask from a mask blank including a punch having a convex surface, a pad having a complementary concave surface, and upper and lower dies having openings therein for receiving the punch and the pad, respectively. Each die also has a complementary nonplanar surface adjacent the opening for clamping the mask blank. Each die surface has a surface contour that substantially matches the extended surface contour of the mask blank when the mask blank lies against the inner edge of the lower die surface, so that wrinkling does not occur when the mask blank is clamped between the upper and lower dies.

DETAILED DESCRIPTION OF THE PREFERRED EMBODIMENT

Figure 1:
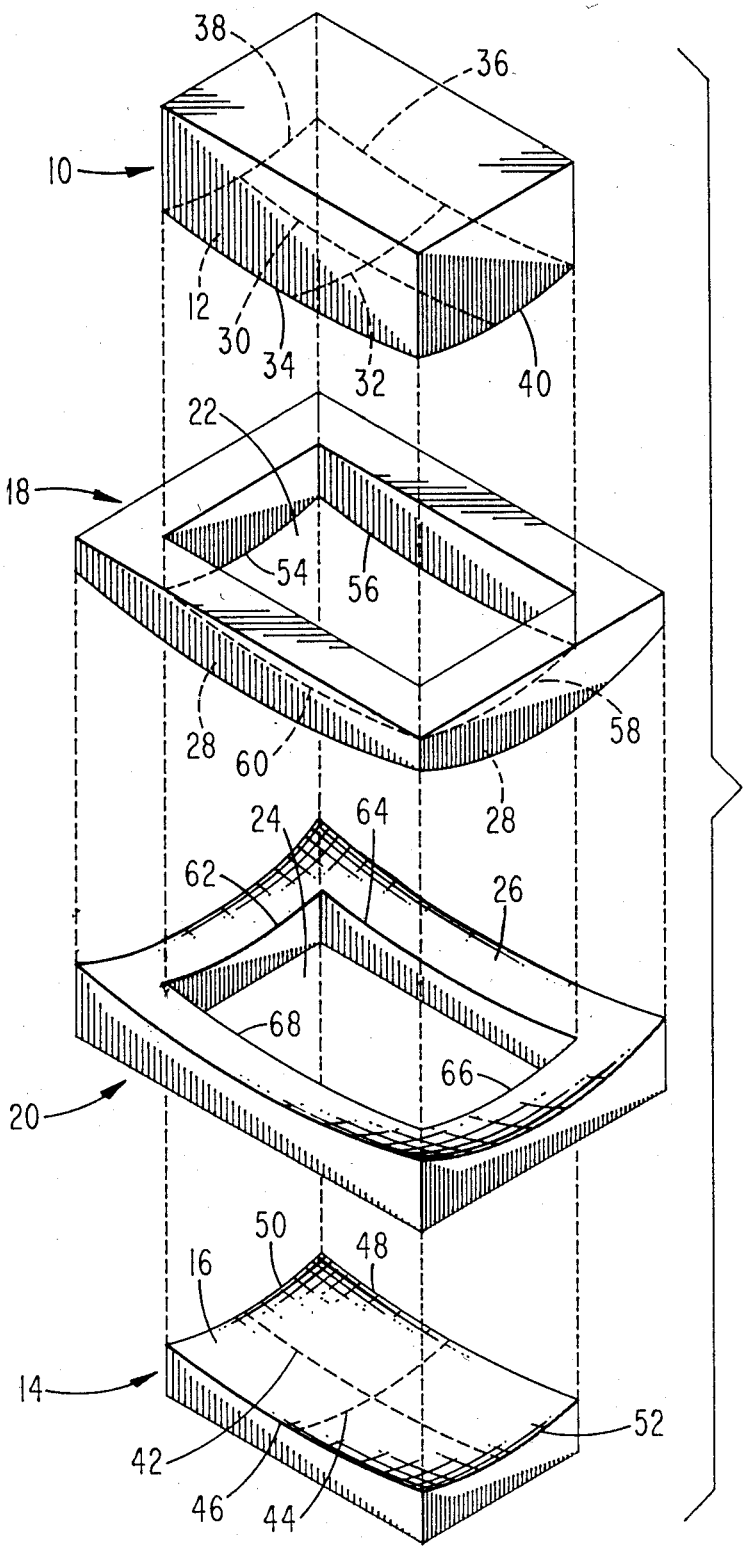
Fig. 1 PRIOR ART
FIG. 1 is an exploded perspective view of a punch, a pad, and upper and lower dies in accordance with a prior art mask-forming apparatus.

FIG. 1 shows a prior-art apparatus for forming a shadow mask which includes a punch 10 having a convex bottom surface 12, a pad 14 having a complementary concave top surface 16, and upper and lower dies 18 and 20 having central rectangular-shaped openings 22 and 24 therein for receiving the punch 10 and the pad 14, respectively. The punch 10, pad 14, and upper and lower dies 18 and 20 preferably are made of steel. The lower die 20 has a nonplanar top surface 26 adjacent the opening 22 for supporting a mask blank (not shown), and the upper die 18 has a nonplanar bottom surface 28 adjacent the opening 24, which is complementary to the surface 26, for mating with the lower die 20 and clamping the mask blank during the mask-forming operation. For clarity, various details of the punch 10, the pad 14, and the upper and lower dies 18 and 20, such as tongue and complementary groove in the lower and upper dies, respectively, to secure the mask blank, holes for receiving pins to locate the mask blank and threaded holes for receiving bolts to secure these elements to a press (not shown), have been omitted since all are well known in the art. The press can be a 200 ton model manufactured by BH Press Corporation, Philadelphia, Pa.

The convex surface 12 of the punch 10 is curved in three dimensions, as indicated by curved dotted lines 30 and 32 lying along intersecting orthogonal planes, respectively. Since the openings 22 and 24 are rectangular in shape, the convex surface 12 has two opposing peripheral edges 34 and 36 which are curved in the same planar direction as the dotted line 30, and two opposing peripheral edges 38 and 40 which are curved in the same planar direction as the dotted line 32. The concave top surface 16 of the pad 14 also is curved in three dimensions, as indicated by curved dotted lines 42 and 44 lying along intersecting orthogonal planes, respectively. The concave surface 16 has two opposing peripheral edges 46 and 48 which are curved in the same planar direction as the dotted line 42, and two opposing peripheral edges 50 and 52 which are curved in the same planar direction as the dotted line 44. The curvature of the dotted lines 42 and 44 and the peripheral edges 46, 48, 50 and 52 matches that of the dotted lines 30 and 32 and the peripheral edges 34, 36, 38 and 40, respectively, of the bottom surface 12 of the punch 10. Thus, the punch 10 and the pad 14 can be placed together without any space therebetween (assuming that a mask blank is not present).

The bottom surface 28 of the upper die 18 is convex curved in three dimensions and has four curved inner edges 54, 56, 58 and 60 which define the opening 22. The top surface 26 of the lower die 20 is concave curved in three dimensions with a surface contour which matches that of the bottom surface 28 of the upper die 18. Thus, the upper and lower dies 18 and 20 can be placed together without any space therebetween (assuming the mask blank is not present). The top surface 26 of the lower die 20 has four curved inner edges 62, 64, 66 and 68 which define the opening 24. Also, the inner edges 54–60 and 62–68 of the bottom and top die surfaces 28 and 26 match the contour of the peripheral edges 34–40, respectively, of the punch surface 12.

Figure 2:
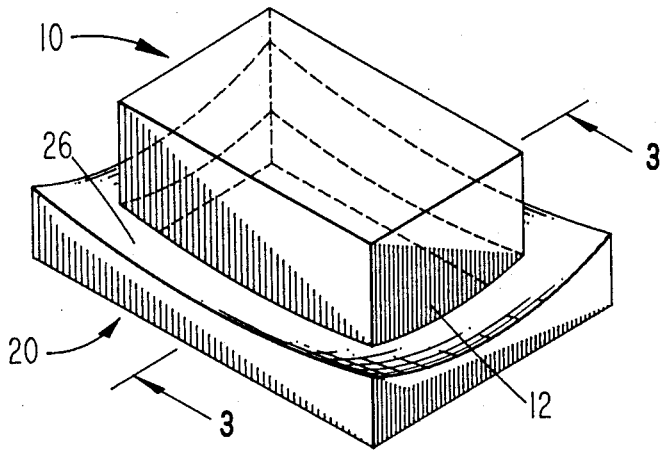
Fig. 2 PRIOR ART
FIG. 2 is a perspective view of the punch and lower die of FIG. 1 shown adjacent to each other.
Figure 3:
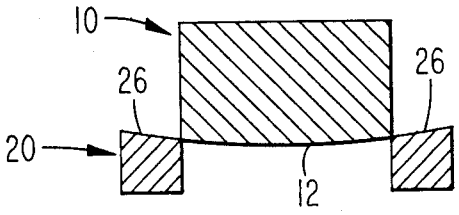
Fig. 3 PRIOR ART
FIG. 3 is a cross-sectional view taken along line 3—3 of FIG. 2.

FIGS. 2 and 3 show the punch 10 and the lower die 20 adjacent to each other. The concave top surface 26 of the lower die 20 has a surface contour which is a continuation of the convex bottom surface 12 of the punch 10, as illustrated in FIG. 3. Consequently, when a flat mask blank is laid onto the lower die surface 26, the surface contour assumed by the blank does not match the surface contour of the die 20, resulting in a wrinkling of the blank as it is clamped between the upper and lower dies 18 and 20.

Figure 4:
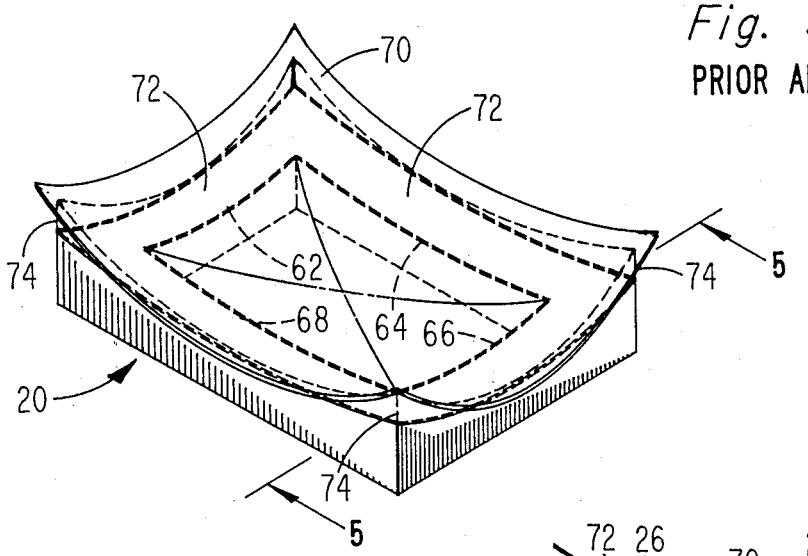
FIG. 4 is a perspective view of a mask blank lying against the inner edge of the lower die of FIG. 1, which illustrates the present novel invention.
Figure 5:
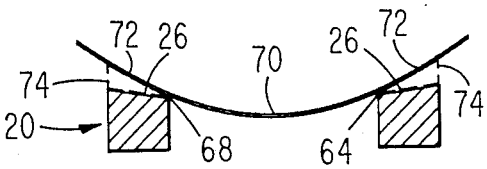
FIG. 5 is a cross-sectional view taken along line 5—5 of FIG. 4.

FIGS. 4 and 5 illustrate the present inventive concept. An unclamped mask blank 70 is pushed down to contact and lie against the inner edges 62, 64, 66 and 68 of the lower die 20. The inner edges 62, 64, 66 and 68 of the lower die 20 support the mask blank 70 and cause it to assume an unwrinkled surface contour different from the top surface 26 of the lower die 20, as shown in FIG. 5. The present invention provides for a die surface 72 which has a surface contour that substantially matches the extended surface contour of the unwrinkled mask blank 70 as it lies against the inner edges 62, 64, 66 and 68 of the lower die 20. The mask blank 70 is supported by a "built-up" section, shown by dotted line 74, which is disposed adjacent the surface 26 of the prior-art die 20. The surface 72 of this built-up section 74 has a concave spherical-like contour which is different from that of the surface 26 in that the corners of this surface 72 are bent upward, as shown in FIG. 4. The upper die 18 would have a surface complementary to the lower die surface 72. Thus, when a mask blank 70 is clamped between the surfaces of the upper and lower dies, wrinkling does not occur since the mask blank conforms to the contour of the die surface 72.

The surface contour of the lower die surface 72 comprises a complex surface, which may be mathematically defined if desired. In manufacturing a die having the surface contour of this complex surface 72, one technique is to support the mask blank 70 on the inner edges 62, 64, 66 and 68 and build a rigid structure on top of the blank 70 which conforms to the contour of this surface 72. Such a structure may be created by an epoxy build-up process wherein thin films are first deposited adjacent to the surface 72, followed by thicker support layers. This rigid structure is then used as a mold for defining the surface contour of the upper and lower dies.

Figure 6:
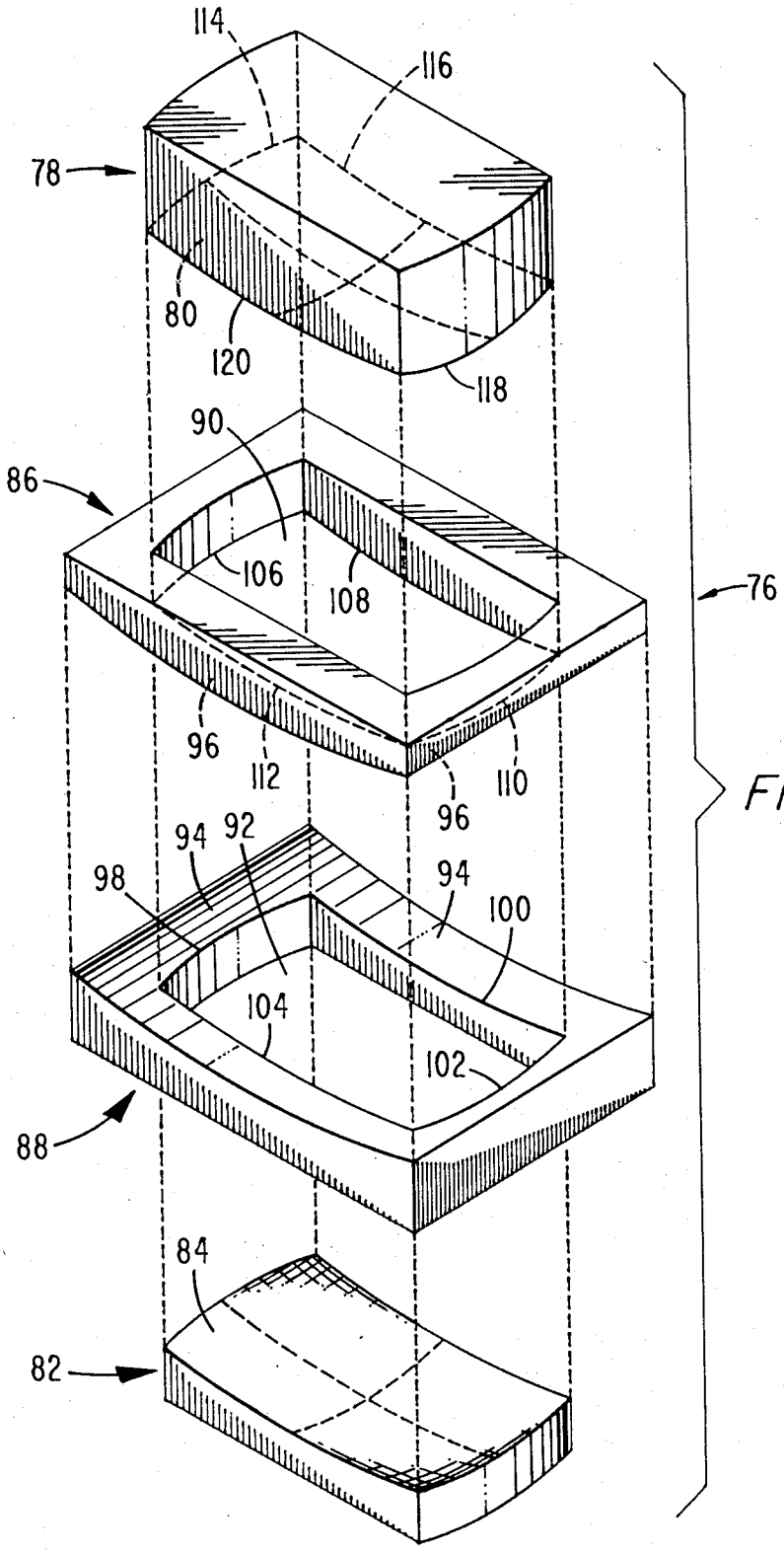
FIG. 6 is an exploded perspective view of one embodiment of the present mask-forming apparatus.

FIG. 6 shows one embodiment of an apparatus 76 incorporating the present invention. The apparatus 76 comprises a punch 78 having a convex bottom surface 80, a pad 82 having a complementary concave top surface 84, and upper and lower dies 86 and 88 having central, substantially rectangular-shaped openings 90 and 92 therein for receiving the punch 78 and the pad 82, respectively. Both the bottom surface 80 and the top surface 84 of the punch 78 and pad 82 have spherical-like surface contours.

The lower die 88 has a continuous cylindrical surface 94 adjacent the opening 92 for supporting a mask blank (not shown), and the upper die 86 has a continuous cylindrical surface 96 adjacent the opening 90, which is complementary to the surface 94, for mating with the lower die 88 and clamping the mask blank during the mask-forming operation. The minor axis of each opening 90 and 92 is oriented parallel to the axis of the cylindrical surfaces 94 and 96. The cylindrical surface 94 of the lower die 88 has four curved inner edges 98, 100, 102 and 104 which define the opening 92, and the cylindrical surface 96 of the upper die 86 has four curved inner edges 106, 108, 110 and 112 which define the opening 90. The inner edges 98–104 and 106–112 of the cylindrical surfaces 94 and 96, respectively, substantially match the contour of the corresponding peripheral edges 114, 116, 118 and 120 of the punch surface 80.

The cylindrical surface 94 allows an unclamped mask blank to lie against and conform to the contour of the lower die surface 94, so that wrinkling of the mask blank does not occur when the blank is clamped between the lower and upper die surfaces 94 and 96. Thus, there is no need to perform a stretching-out process on the shadow mask, which may result in a lowering of color purity in larger size cathode-ray tubes and in high-resolution display tubes.

What is claimed is:

1. In an apparatus for forming a shadow mask from a mask blank including a punch having a convex surface, a pad having a complementary concave surface, and upper and lower dies having openings therein for receiving said punch and said pad, respectively, each die having a complementary nonplanar surface with an inner edge adjacent said opening for clamping said mask blank, the improvement comprising:

each die surface having a surface contour that substantially matches the extended surface contour of said mask blank when said mask blank lies unclamped against the inner edge of said lower die surface, so that wrinkling does not occur when said mask blank is clamped between said upper and lower dies.

2. An apparatus as defined in claim 1 wherein the surface contour of said lower die surface comprises a concave spherical-like surface, and the surface contour of said upper die surface comprises a convex spherical-like surface.

3. An apparatus as defined in claim 1 wherein the surface contour of each die comprises a continuous cylindrical surface.

4. An apparatus as defined in claim 3 wherein the opening in each of said dies is substantially rectangular in shape with the minor axis thereof being oriented parallel to the axis of said cylindrical surface.

5. An apparatus as defined in claim 4 wherein the opposing inner edges of each die surface, disposed along the short sides of said die opening, have an arcuate contour.

6. An apparatus as defined in claim 5 wherein the inner edges of each die surface substantially match the contour of the peripheral edges of said punch surface.

* * * * *